United States Patent [19]

Kale

[11] 3,935,602

[45] Feb. 3, 1976

[54] TRAPS FOR SINKS, LAUNDRY TUBS AND THE LIKE

[76] Inventor: Howard D. Kale, 4621 Gulf of Mexico Drive, Longboat Key, Fla. 33548

[22] Filed: Aug. 19, 1974

[21] Appl. No.: 498,291

[52] U.S. Cl. ..... 4/292; 4/DIG. 14; 137/247.41; 210/435

[51] Int. Cl.[2] ..... E03C 1/26; E03C 1/264

[58] Field of Search ..... 4/1, 10, 69, 207, 255, 4/256, 257, 286, 290, 291, 292; 138/92, 103, 108, 37, 40, 178; 137/247, 247.41 X, 247.51, 544, 545, 550, 559; 285/157; 210/320, 435, 445, 167, 463, 455, 470, 477, 447; 15/104.3 R, 187

[56] References Cited

UNITED STATES PATENTS

| | | | |
|---|---|---|---|
| 594,169 | 11/1897 | Catsiff | 210/435 X |
| 1,198,759 | 9/1916 | Pinder et al. | 137/247.51 |
| 1,217,763 | 2/1917 | Hirrich | 137/247.41 X |
| 1,817,376 | 8/1931 | Izquierdo | 4/291 UX |
| 1,886,676 | 11/1932 | Heuacker | 15/104.3 R |
| 2,506,669 | 5/1950 | Heuacker | 4/292 |
| 2,593,734 | 4/1952 | Davis | 137/247.51 |
| 2,742,101 | 4/1956 | Stambaugh | 137/247.41 |
| 3,466,901 | 9/1969 | Reid | 210/167 X |

*Primary Examiner*—Richard E. Aegerter
*Assistant Examiner*—Stuart S. Levy
*Attorney, Agent, or Firm*—Max R. Kraus

[57] ABSTRACT

A trap for use in connection with sinks, laundry tubs, and the like, with the bottom wall of the dip portion of the trap having an elongated opening, a bottom or closure member detachably secured to the trap for closing the opening, and blocking means secured by said bottom or closure and having means extending into the trap and into the bottom or closure member for blocking the passage of foreign objects and the like without interfering with the flow of the water. The bottom or closure member is readily removable for access to the interior of the trap for cleaning same and the like.

7 Claims, 11 Drawing Figures

TRAPS FOR SINKS, LAUNDRY TUBS AND THE LIKE

BRIEF SUMMARY OF THE INVENTION

One of the objects of this invention is to provide a trap for use in connection with sinks, laundry tubs, and the like, in which the trap is provided with removable means which will serve to prevent the passage therethrough of any foreign object yet will not obstruct the flow of water. Conventional traps are provided with the usual drain plug which closes the bottom opening in the trap and is removed by means of a wrench to gain access into the interior of the trap. In such traps, either the J or P-type trap, there is no means for trapping the passage of foreign substances or objects such as hair and the like which may pass through the trap and clog the pipe line by either becoming deposited in the deepest part of the trap or in the pipe line past the trap. If the foreign substance or object becomes lodged in the deep part or dip of the trap a wrench or the like must be used, preferably by a plumber, for the purpose of removing the plug and gaining access into the interior of the trap. If the foreign substance or object passes the trap and remains in the pipe line it becomes a laborious job to clean out or unclug the line and usually requires the services of a plumber for that purpose.

One of the objects of this invention therefore is to provide a new form of trap having an enlarged oval-shaped opening at the bottom of the dip portion of the trap which is closed by a removable closure having a concave shape and which supports a plurality of blocking fingers extending into the dip of the trap as well as into the removable closure, which blocking fingers serve to prevent the passage therethrough of a foreign object without interfering with the passage or flow of the water, and where the closure may be readily removed by a housewife for the purpose of cleaning the trap and removing the foreign object, thereby eliminating the need for the services of a plumber or trained personnel heretofore required.

BRIEF DESCRIPTION OF THE DRAWINGS

In the drawings:

FIGS. 1 – 7

Figure 1:
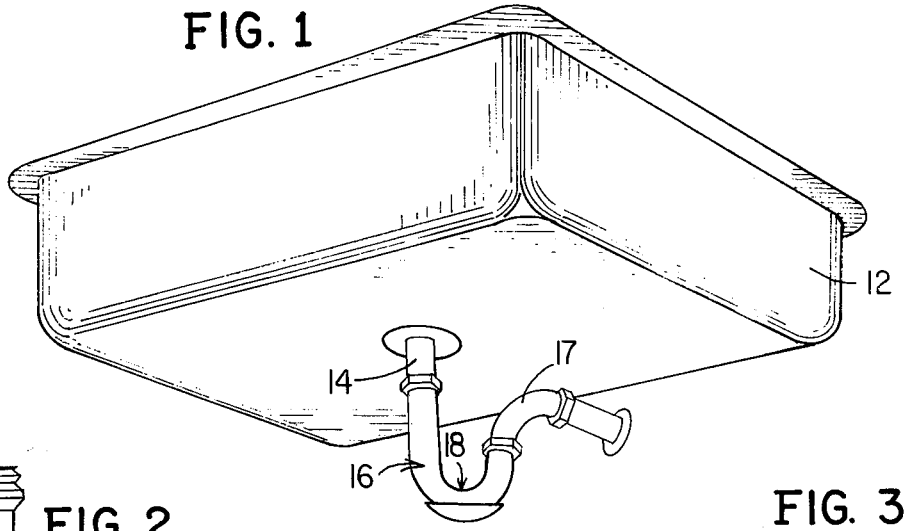
FIG. 1 is a perspective view of a conventional sink or tub showing the trap of this invention connectted at one end to the inlet and the opposite end of the trap connected to the outlet pipe.
Figure 2:
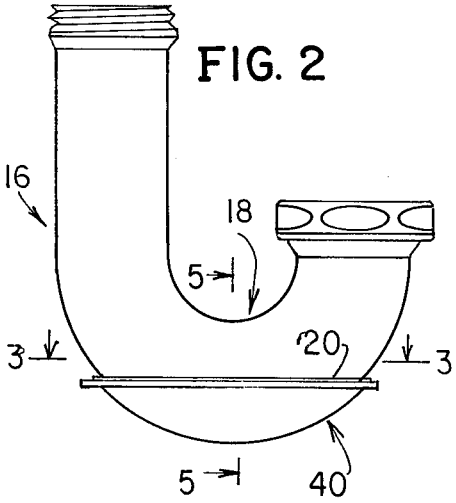
FIG. 2 is a side elevational view of the improved trap forming this invention.

The embodiment shown in FIGS. 1 through 7 will be first described. The conventional sink, wash basin or laundry tub, indicated at 12, has a short inlet pipe 14 connected thereto. The improved trap unit generally indicated at 16 is connected at one end to the pipe 14 and at its other end to the outlet pipes 17. Conventional coupling means are used to connect the trap 16 to said pipes.

The invention herein resides in the trap unit. The trap unit 16 has the conventional dip portion 18 and the bottom portion 20 of the trap at said dip is open to provide a generally oval-shaped bottom opening 22 in the said trap. The oval-shaped opening 22 is shaped similar to the oval shape of the rim of the blocking member 24 shown in FIG. 4.

The blocking member generally indicated at 24 is integrally molded of rubber or plastic material and comprises a rim 26 which is oval-shaped and has a plurality of transversely extending cross-members 28 spaced from each other. Extending upwardly and downwardly from said cross-members are spaced blocking fingers 30 which are generally tapered or cone-shaped with the free ends 32 being of reduced diameter in relation to the base portion of said fingers. The fingers may be provided with spaced openings 31 to further facilitate the flow of water without interfering with the blocking function of the fingers.

Extending from the opposite sides of the rim 26 are side members generally indicated at 34 which extend upwardly and are of inverted U-shape as indicated at 36 and terminate in outwardly extending horizontal flanges 37. The opposite ends 38 of the rim 26 are generally flat or planar. The entire blocking member 24 is integrally formed.

The bottom closure member generally indicated at 40 comprises a concave-shaped body or cup-shaped shell 42 having a continuous outwardly extending flange 44, which flange is below the top edge 46 of the bottom closure 40 to provide an upper rim 48 adjacent the top of the bottom closure 40. The opposite sides and one end of the rim 48 extends vertically and said end of the rim has spaced pointed projections 50, while the opposite end of the rim is inclined as indicated at 48'. In top plan view, the bottom closure 40 is oval-shaped complementary to the oval shape of the blocking member 24 as well as the oval-shaped bottom opening 22 in the bottom of the trap.

Figure 3:
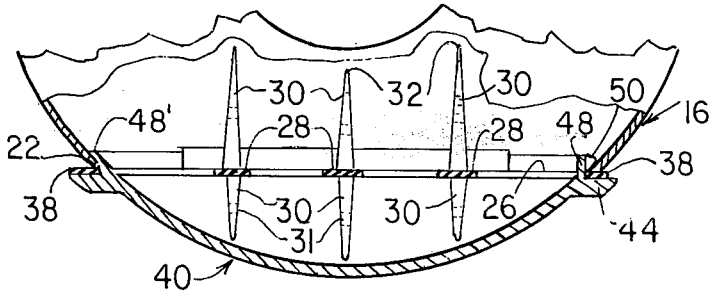
FIG. 3 is a sectional view taken on line 3—3 of FIG. 2.
Figure 4:
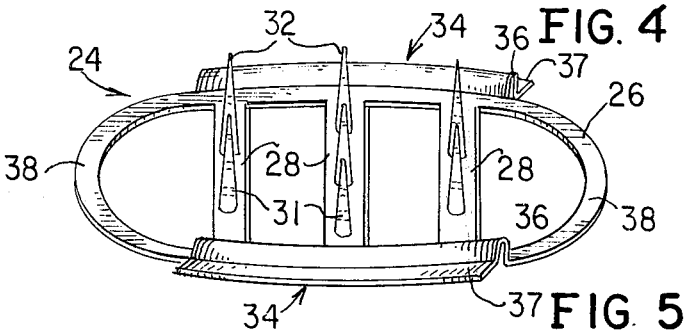
FIG. 4 is a perspective view of the means having the blocking fingers which serve to block the flow of any foreign object.
Figure 7:
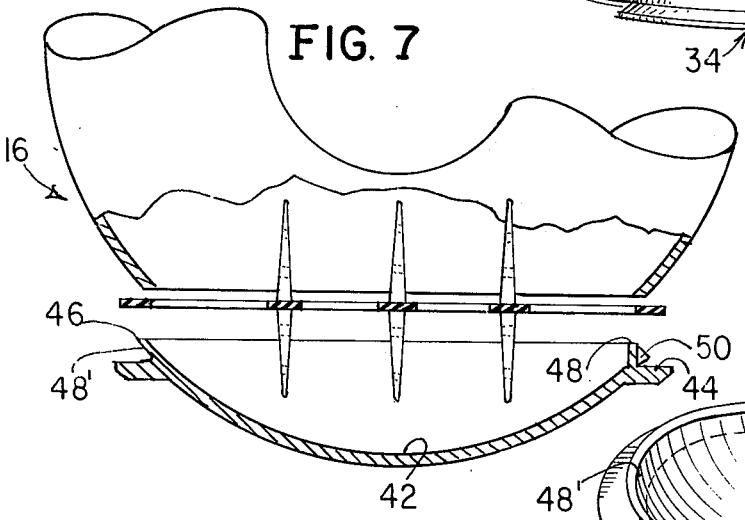
FIG. 7 is an exploded view of the lower portion of the trap with the blocking means and the bottom closure or shell or cup-shaped member.
Figure 5:
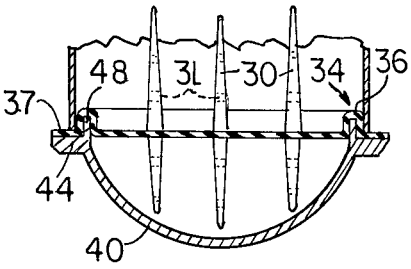
FIG. 5 is a sectional view taken on line 5—5 of FIG. 2.
Figure 6:
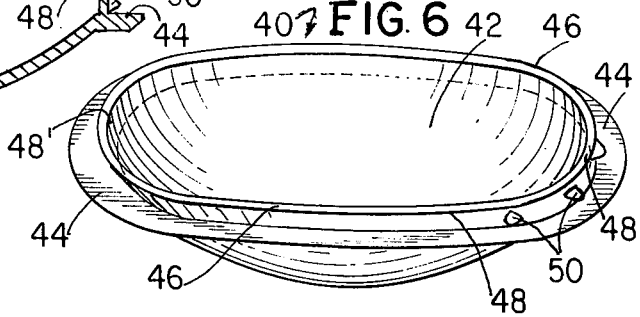
FIG. 6 is a perspective view of the bottom shell.

The blocking member 24 and the bottom or closure member 40 may be readily assembled and secured to the trap 16 in the following manner. The blocking member 24 is positioned over the open top of the bottom closure member 40 with the side members 34 of the rim 26 of the blocking member 24 positioned over the vertical sides 48 of the rim of the bottom closure member 40. The inclined rim edge 48' is first inserted into the opening 22 and the bottom closure 40 is pushed upwardly into the bottom opening of the trap, with the projections 50 engaging and interlocking with the wall of the trap adjacent the bottom opening, as best seen in FIG. 3, to hold the bottom closure 40 secured to the trap and the blocking member 24 in secured position therebetween. In this assembled position the blocking fingers 30 extend upwardly into the interior of the trap and downwardly in the direction of the bottom of the closure member 40, as best seen in FIG. 3. The plurality of blocking fingers 30 may be staggered and thus will not interfere with the flow of water from the sink. Should any foreign matter pass from the sink into the trap, the blocking fingers 30 will serve to block the passage of the foreign substance or object through the trap 16 but will permit the flow of the water to continue to flow through the trap.

When there is an accumulation of such foreign matter in the lower portion of the trap and the flow of water is impeded and water is caused to back up into the sink, the housewife is put on notice that there is a blockage in the trap and she can readily correct this by detaching the bottom closure 40 from the trap by merely applying a downward pressure against the flange 44 of the bottom closure and the projections 50 will disengage from the wall of the trap and permit disengagement of the bottom closure from the trap. In this manner she can remove the bottom closure 40 and the blocking member 24 and then remove the foreign substance which has been held by said blocking member.

Figure 8:
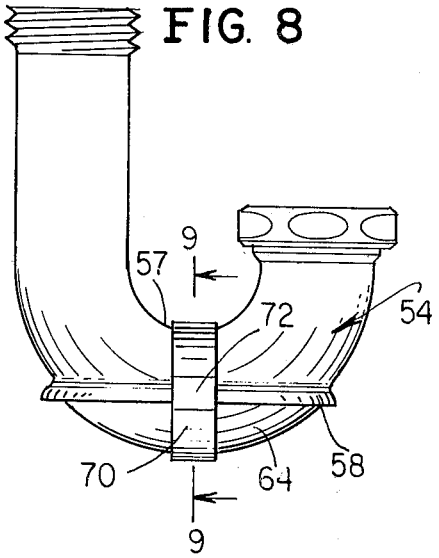
FIG. 8 is a side elevational view of a modified form of this invention.
Figure 9:
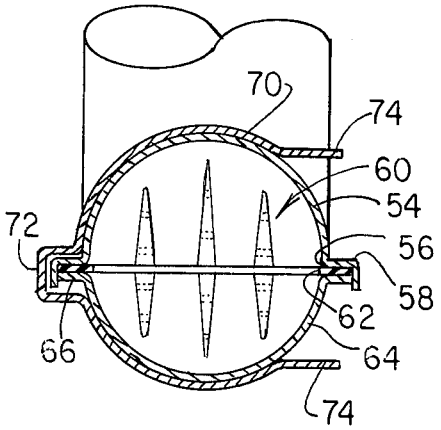
FIG. 9 is a view taken on line 9—9 of FIG. 8.

FIGS. 8 and 9

FIGS. 8 and 9 show a modification in which the trap 54 is likewise provided with an oval-shaped bottom opening 56 which extends across the full length and width of the bottom of the trap. An inverted L-shaped continuous flange 58 extends outwardly of the trap adjacent the bottom opening 56.

The blocking member generally indicated at 60 is similar to that previously described except that it has a continuous oval-shaped flat rim 62, similar to the flat ends 38 of the rim 24. Also, the bottom closure member 64 has a continuous outwardly extending flange 66 which engages the underside of the flat rim 62, as shown in FIG. 9. A C-shaped clamping member 70, preferably of spring steel, having a recessed portion 72 at the rear extends around the dip of the trap and the bottom closure member 64 to hold the bottom closure member 64 and blocking member 60 in secured position. The free ends 74 of the clamping member may be manually engaged for removing the clamping member and disengaging the parts for cleaning and the like.

Figure 10:
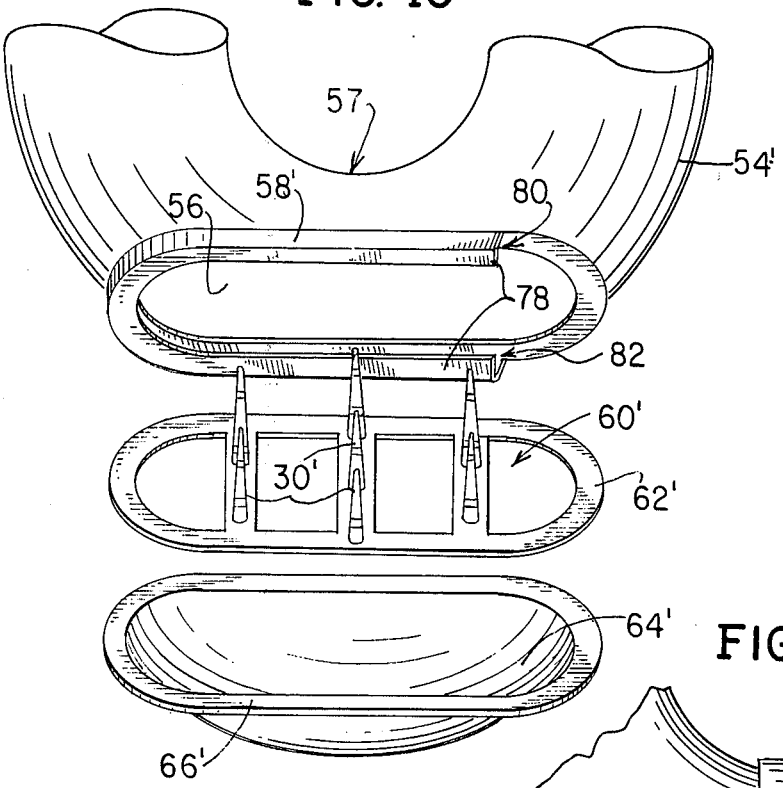
FIG. 10 is an exploded view of another modification.
Figure 11:
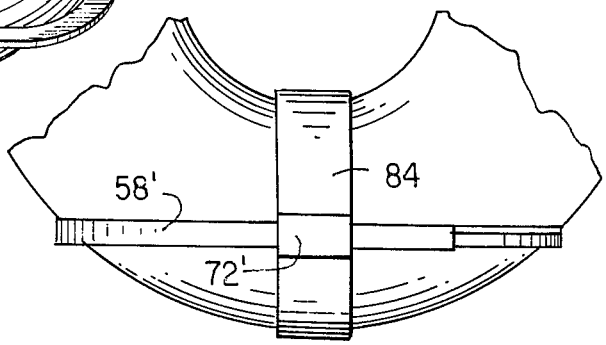
FIG. 11 is a view of parts of FIG. 10 in assembled relation with a strap for holding same in assembled relation.

FIGS. 10 and 11

The structure shown in FIGS. 10 and 11 is generally similar to that described in FIGS. 8 and 9 and will be given the same numbers primed. Instead of the continuous inverted L-shaped flange 58, there is provided an additional inwardly extending lip or flange 78 for the major portion of the bottom to provide a track 80 to slidingly receive the blocking member 60' and the bottom closure member 64'. The track 80 is open at one end as at 82 to permit the sliding insertion of the blocking member 60' and the bottom closure member 64' from the free open end. A clamping member 84, similar to clamping member 70, is provided to hold the parts in assembled relationship.

In connection with each of the embodiments, it will be understood that after the bottom closure is detached from the trap and the blocking member is removed and the trap cleaned of the foreign objects, the parts are reassembled and the trap unit is then again functional.

What is claimed is:

1. In a trap unit for use in connection with sinks, laundry tubs and the like, said trap unit comprising a conduit having a dip portion with an opening faced adjacent thereto, and a bottom closure member for closing said opening, a blocking member comprising a horizontal rim and transversely extending horizontal cross-members and a plurality of vertically spaced fingers on said horizontal cross-members, said blocking member positioned so that the rim thereof rests horizontally on said closure member and is positioned between the closure member and the dip portion of the conduit with said vertically spaced fingers extending into the dip portion of the conduit, and means for detachably securing said bottom closure member to said dip portion of said conduit.

2. The structure as set forth in claim 1 in which the opening is of generally oval-shaped configuration and in which the bottom or closure is of a concave or cup shape, and in which the blocking member also extends into said bottom or closure.

3. The structure as set forth in claim 2 in which the blocking member comprises a plurality of spaced fingers which extend upwardly and downwardly of said opening.

4. The structure as set forth in claim 1 in which the blocking unit has fingers which have openings therethrough.

5. The structure as set forth in claim 1 in which the blocking member is formed of a plastic or rubber material.

6. The structure as set forth in claim 1 in which the fingers are tapered.

7. The structure as set forth in claim 1 in which clamping means are used to secure said bottom or closure member to said conduit.

* * * * *